US005287034A

United States Patent [19]

Kamohara et al.

[11] Patent Number: 5,287,034

[45] Date of Patent: Feb. 15, 1994

[54] FLAT DISPLAY DEVICE FOR DISPLAYING AN IMAGE UTILIZING AN ELECTRON BEAM, WHICH IS PROVIDED WITH A SUPPORT ARRANGEMENT FOR SUPPORTING A SINGLE FACEPLATE

[75] Inventors: Eiji Kamohara; Takashi Nishimura, both of Fukaya, Japan

[73] Assignee: Kabushiki Kaisha Toshiba, Kawasaki, Japan

[21] Appl. No.: 745,461

[22] Filed: Aug. 14, 1991

[30] Foreign Application Priority Data

Aug. 16, 1990 [JP] Japan ..... 2-216207
Aug. 28, 1990 [JP] Japan ..... 2-226288
Nov. 30, 1990 [JP] Japan ..... 2-336701

[51] Int. Cl.[5] ..... H01J 29/86

[52] U.S. Cl. ..... 313/422; 313/477 R; 220/2.1 A

[58] Field of Search ..... 313/422, 2.1, 477 R, 313/495; 220/2.1 A, 2.3 A

[56] References Cited

U.S. PATENT DOCUMENTS 4,145,633 3/1979 Peters et al. ..... 313/422
4,166,233 8/1979 Stanley ..... 313/422
4,622,492 11/1986 Barten ..... 313/422

FOREIGN PATENT DOCUMENTS 0079108 5/1983 European Pat. Off. .
0356823 3/1990 European Pat. Off. .
56-106353 8/1981 Japan .
62-272432 11/1987 Japan .

OTHER PUBLICATIONS

Nanomura et al., "A 40-in. Matrix-Driven High-Definition Flat-Panel CRT", Proceedings of SID, vol. 30/4, 1989.

EPO, Patent Abstracts of Japan, Pub. No. JP63164149, Jul. 7, 1988.

EPO, Patent Abstracts of Japan, Pub. No. JP62150638, Dec. 15, 1987.

*Primary Examiner*—Donald J. Yusko
*Assistant Examiner*—John Giust
*Attorney, Agent, or Firm*—Cushman, Darby & Cushman

[57] ABSTRACT

A vacuum envelop is formed of at least a flat and rectangular faceplate 21 on which a fluorescent screen is formed, a side wall 22 extending in a direction, which is substantially perpendicular to the faceplate 21, from a peripheral portion of the faceplate, and a rearplate 23 opposing to the faceplate 21. A plurality of rod-shaped support members 31 whose top end portions are wedge-shaped are arranged between the faceplate 21 and the rearplate 23, and a ratio t/P is set to 0.05 or more where t is a thickness of the faceplate and P is an interval between adjacent support members.

20 Claims, 12 Drawing Sheets

0 mm 0.5 mm 1 mm 2 mm 3 mm 4 mm 5 mm 12 mm 7 mm 15 mm 10 mm 20 mm

FLAT DISPLAY DEVICE FOR DISPLAYING AN IMAGE UTILIZING AN ELECTRON BEAM, WHICH IS PROVIDED WITH A SUPPORT ARRANGEMENT FOR SUPPORTING A SINGLE FACEPLATE

BACKGROUND OF THE INVENTION

1. Field of the Invention

The present invention relates to a flat display device for displaying an image by utilizing an electron beam, which is provided with a support arrangement for supporting a single faceplate and, particularly to a flat display device wherein a flat faceplate is provided, a fluorescent screen formed on the faceplate that is defined as a continuous arrangement of a plurality of segment regions, the respective segment regions are scanned by an electron beam, and one image is formed on the screen surface.

2. Description of the Related Art

In the prior art a cathode-ray tube has been used as a typical display device in which a fluorescent screen in a vacuum envelop is scanned by an electron beam and an image is displayed on the screen. In recent years, various studies have been made for a high definition broadcasting or a high resolution picture tube having a large screen. In order to obtain a high resolution of the picture tube, a spot diameter of the electron beam in the screen must be minimized. Conventional improvements have been made concerning the structure of the electrode of an electron gun, by enlarging the diameter of electron gun itself, and the elongation thereof, but have proven to be insufficient. The main reason lies in that the distance between the electron gun and the screen becomes longer as the diameter of the tube becomes large so that magnification of the electron lens becomes too large. In other words, in order to achieve high resolution, it is important to shorten the distance between the electron gun and the screen. For this purpose, the tube is designed as a wide angle deflection tube. However, in such a tube, the magnification at the center region of the screen differs from that at the peripheral region thereof.

Due to this, in Japanese Patent Disclosure No. 48-90428 and Japanese Patent Disclosure No. 49-21019, and Japanese Utility Model Disclosure No. 53-117130, there has conventionally been proposed a method for displaying a large screen image having high resolution by arranging a plurality of independent small-sized picture tubes. This type of method is useful for a huge screen image display having a large number of divisions, which is arranged outside. However, in a case of an intermediate large-sized screen display of about 40 inches, it is obvious that the displayed image is not clearly seen since the connecting portion of the screen of each region, that is, the connection portions between the small-sized picture tubes are conspicuous in particular, if such a display is used as a display terminal for a computer aided design (CAD) and graphics, it goes without saying that having such a connecting portion in the display screen is a decisive defect as a display device. To solve this problem, in U.S. Pat. No. 3,071,706, Japanese Utility Model Disclosure No. 39-25641, Japanese Patent Disclosure No. 42-4928, and Japanese Patent Disclosure No. 50-17167, there has been proposed the structure in which a plurality of independent picture tubes are integrated into a screen.

As shown in FIGS. 1A and 1B, a picture tube 1 comprises a vacuum envelop having the integrated screen structure comprises a faceplate 3 having a screen 2, a rearplate 4 opposing to the faceplate 3, a plurality of funnels 5, which is continuous to the rearplate 4, and a plurality of necks 6, which are continuous from the funnels 5, respectively. The faceplate 3 is made of glass, and the rearplate 4 is made of glass or metal. In the above-mentioned structure, if the screen 2 is enlarged, the faceplate 3 and the rearplate 4 must be considerably thickened to have a sufficient strength against atmospheric pressure. Also, large curvature in a direction of a tube axis must be provided. Due to this, the weight of the entire vacuum envelop becomes extremely heavy, and the screen 2 has curvature in the direction of the tube axis and the displayed image on the screen is not clearly seen. Moreover, the distance between the screen 2 and an electron gu assembly 7 received in the neck 6 becomes large, and this is unfavorable in view of the design of an electron lens.

In a case where the rearplate is made of metal, a method is known for forming a reinforcing plate from a relatively thin metal plate in order to maintain sufficient strength against atmospheric pressure and lighten the device. The metallic rearplate is very useful for a case where there is no projection member such as a funnel and a neck in the rear surface portion of the display device. Moreover, a conventionally complicated shape can be simply formed if a metallic plate is applied to the structure of an envelop of the display device such as a cathode-ray tube wherein funnels and necks are formed on the rear surface portion. However, in the cathode-ray tube wherein the funnels and the necks are connected to the rearplate and a fluorescent screen is dividedly scanned by a plurality of electron beams, the electron gun assembly and the fluorescent surface must be correctly placed at a predetermined position. However, the metallic rearplate is easily deformed by atmospheric pressure as compared with the glass rearplate. Due to this, the position of the electron gun is changed by the deformation of the metallic rearplate, and the electron beam can not be emitted from the predetermined position to the predetermined direction. As a result, definition of the display image is extremely reduced. Therefore, the metallic rearplate is useful for a display device, where there is no influence on an internal structure or a track of the electron beam, even if the rearplate is a little deformed. Yet in a case where such a metallic plate is used in the structure wherein the funnels and necks are formed in the rearplate, an amount of deformation must be calculated in advance and the electron gun must be arranged at a predetermined position after the deformation. This is unfavorable in view of the design and the manufacture of the cathode-ray tube.

Moreover, in the cathode ray tube in which the internal section of the envelop becomes an equipotential space having high potential, an electrically insulating structure must be formed in the inside of the rearplate, so as the high potential is not exposed outside. In the cathode-ray tube wherein the funnels and necks are connected to the rearplate, potentials are extremely high, and thus such structures are unfavorable for practical.

The glass molding which comprises the rearplate 4, which corresponds to the funnel of the conventional cathode-ray tube as shown in FIGS. 1A and FIG. 1B, cannot be shaped to have sharp angles and still possess sufficient strength to support against the atmospheric pressure. Therefore, the rearplate cannot help but be formed in order that the entire shape curves smoothly. Therefore, it is extremely difficult to form the shape of the portion, on which a deflection device is mounted, to be equal to the shape of a deflecting region of the electron beam. Also, it is extremely difficult to thin glass of the deflection device mounting portion. Therefore, it is impossible to use a small-sized deflection device having small deflecting electric power.

Moreover, even if there is used a cathode-ray tube in which a metal plate is used as a rearplate, the shape of the inner surface of a funnel of the portion where a deflecting yoke is mounted is made close to the track region of the actual electron beam, and the thickness of the funnel is formed to be thinned, the following disadvantages will occur.

An eddy current is generated in the metallic plates adjacent to the detection devices, and it is difficult to avoid generating loss by the eddy current. As a result, deflecting electric power increases. Moreover, in a case where the metallic plate is used, the metallic plate is structured to be arranged between the adjacent detection devices, and the magnetic fields of the deflection detection devices are easily interfered with each other. Due to this, it is extremely difficult to form a suitable distribution of the magnetic field.

In general, in the use of a vacuum envelop having a flat faceplate, it is well-known to use support members to support the faceplate having a large area in connection with a solar energy collecting device. Such a flat display device using the support members has been proposed in Japanese Patent Disclosure No. 56-106353, Japanese Patent Disclosure No. 62-272432, Japanese Patent Disclosure No. 62-285335, Japanese Patent Disclosure No. 63-128532, Japanese Patent Disclosure No. 48-90183, Japanese Patent Disclosure No. 64-10553, and Japanese Patent Disclosure No. 1-117251.

As shown in FIGS. 2 and 3, there are used long plate-like support members 11 or needle-like support members supporting against the atmospheric pressure, which is applied to a flat envelop 10 whose inside is vacuum exhausted. The long plate-like support members 11 are used in order to prevent load of atmospheric pressure from concentrating on one point by supporting a screen 12 at the large contact area. An inventor found out various problems in the structure having the long plate-like support members 11 as a result of the various experiments.

First, there is a problem in accuracy of processing the support members. In this structure, as shown in FIG. 4, an end portion 11*a* of the support member, which contacts the screen along a black stripe 12*a* of the screen, must be processed to be shaped like a knife-edge. Furthermore, it is necessary to completely conform the distance between the faceplate and the rearplate to the length of the support members, that is, the height thereof. If a length of the knife-edge portion along the longitudinal direction thereof is about 30 mm or less, such a process can be practically performed, that is, such a process can be performed in terms of quantity. However, if the length thereof is more than 30 mm, a special process is required, and the device cannot be manufactured at low cost.

Second, there is a problem in strength of the plate-like support members. In the use of the plate-like support members, strength is large in a case where load is applied in a direction parallel to the surfaces of the plate-like support members. However, if load is applied in a direction, which is inclined to the surfaces, the plate is easily deformed and excessive load is applied to the other adjacent support members.

Third, there is a problem in a method for fixing the plate-like support members. Since the plate-like support members cannot stand itself, there is required a member for setting up the plate-like support members to be perpendicular to the rear panel, or a fixture in a case of welding in order to attach the plate-like support members to the rear panel.

Fourth, there is a problem in deformation. The plate-like support members are strong against the deformation in a direction in a surface, but easily deformed in the direction other than the inner surface direction. As shown in FIG. 5, deformation 11*b* is easily generated during a fixture or a heating process.

Fifth, there is a problem in the contact between the plate-like support members and the sheet glass. Since the normal sheet glass is manufactured by a float method, it is impossible to completely equalize the thickness of the whole sheet glass. Regarding the distribution of the thickness of the sheet glass, there is no difference in the thickness in the relatively narrow portion, for example, about 50 mm. However, in the relatively large portion, for example, about 200 mm, a difference in thickness can range from 0.05 mm to 0.1 mm. In other words, even if the plate-like support members are accurately processed and assembled, the complete contact between the plate-like support members and the sheet glass serving as a faceplate is not always made.

Regarding the needle-like support members, the following problems exist:

First, there is a problem in the required number of needle-like support members, needed to support against the atmospheric pressure. In the plate-like support members, the contact area between the plate-like support members and glass is relative large. In contrast, the contact area between the needle-like support members and glass is extremely small, and therefore a considerably large number of needle-like support members are needed in order to reduce load weight of each support member. More specifically, the needle-like support members must be arranged with a pitch of 10 mm or less, and a 1000 or more needle-like support members are needed in order to support against the atmospheric pressure applied to the sheet glass whose size corresponds to 20 inches of the diagonal size of the screen.

Second, there is a problem in accuracy of processing. According to this method, the top end portion of the member must be processed to be needle-like. Generally, a method for processing a wire material to be needle-like can be easily processed by a cylindrical grinding. However, it is difficult to accurately position the central axis of the wire material and the top end portion portion of the processed needle-like member, and there often occurs cases where the central axis of the wire material and the top end portion are eccentrically processed.

Third, there is a problem in strength of the needle-like support members. Similar to the case of the plate-like support members, strength is adequate in a case where load is applied in an axial direction of the wire material. However, if load is applied in a direction, which is inclined to the axis, the plate is easily deformed and excessive load is applied to the other adjacent support members.

Fourth, there is a problem in a method for fixing the needle-like support members. Similar to the case of the plate-like support members, since the thin needle-like support members cannot stand by themselves, there is required a member for setting up the needle-like support members to be perpendicular to the rear panel, or a fixture in a case of welding in order to attach the needle-like support members to the rear panel.

As mentioned above, the plate-like or needle-like support members are not favorable for practical use in view of the structure, manufacturing, assembling, and the cost. Moreover, the conventional flat cathode-ray tubes, which have been proposed, include a large number of wire cathodes 13, a large number of control electrodes 14, accelerating electrodes 15, deflecting electrodes 16 therein. The structure is very complicated, and there are many problems in the manufacture. If the large-sized screen is used, the manufacture of the cathode-ray tube becomes extremely difficult. Moreover, since it contains a large number of support members and inner electrodes, there occurs a problem on occluded gas of these members. As a result, a life characteristic of the cathode-ray tube is largely deteriorated, and this is considerably unfavorable for practical use.

As mentioned above, there are various problems in the prior art to obtain a cathode-ray tube having high resolution, a small depth, good visible image, simple structure, high practical use, and high industrial value.

SUMMARY OF THE INVENTION

An object of the present invention is to provide a flat display device having high practical use and high industrial value.

According to the present invention, there is provided a display device comprising: a vacuum envelope including a first flat plate having an inner surface and a thickness t and a second flat plate faced to the inner surface of said first plate; a fluorescent screen formed on the inner surface of said first plate; means for generating first electron beams which dividedly scan said fluorescent screen, respectively; and a plurality of support members for supporting said first and second plates, which are provided between said first and second plates and are arranged on said screen at a predetermined interval P, wherein a ratio t/P is 0.05 or more.

Also, according to the present invention, there is provided a display device comprising: a vacuum envelope including a first flat plate having an inner surface and a thickness t and a second flat plate faced to the inner surface of said first plate; a fluorescent screen formed on the inner surface of said first plate; means for generating first electron beams which dividedly scan said fluorescent screen, respectively; and a plurality of support members for supporting said first and second plates, which are provided between said first and second plates and are arranged on said screen at a predetermined interval, each of said support members having a top end portion contacting said screen and the top end portion being formed into a wedge-shape and have a length of 2 mm to 3 mm along its longitudinal direction.

In the display device of the present invention, a screen is formed in the inner surface of a glass faceplate, which is a flat first plate. The flat rearplate, which is used as a second plate forming the vacuum envelop together with the first plate, is arranged to be opposed to the glass faceplate. Also, there are arranged support members to support against atmospheric pressure between these plates. Moreover, a plurality of electron gun assemblies, which generates an electron beam, is arranged to be opposed to the screen. The support members are arranged on the screen to maintain predetermined intervals P. In a case where a ratio t/P is 0.05 or more wherein the thickness of the faceplate is t, the number of support members can be largely reduced with the minimum thickness of the faceplate. Due to this, the weight of the display device can be reduced, and the number of support members is small, so that the manufacture can be made extremely easily.

Further, since the faceplate and the rearplate are flat, the distance between the electron gun and the screen can be made minimum and set in the same manner, the magnification of the electron lens in the electron gun can be made small, the stop on the screen can be made small, thereby an image having high resolution can be formed. Moreover, the depth of the display device can be shortened, and the weight of the display device can be reduced as compared with the area of the screen, thereby an image having good visibility can be formed on the screen.

Also, in the display device of the present invention, the display segment regions, which correspond to the screen portion of a plurality of independent picture tubes, are formed in the inner surface of the flat faceplate and the flat rearplate, and the support members are arranged between these plates. At this time, the side end portion of the first plate of the support members is wedge-shaped. The length in a longitudinal direction of the wedge-shaped end portion is set to 2 mm to 30 mm, thereby the thickness of the faceplate can be thinned as much as possible, and the number of the support members can be greatly reduced. Due to this, the weight of the display device can be reduced, and the number of support members is small, so that the manufacture can be made extremely easily.

Further, since the faceplate and the rearplate are flat, the distance between the electron gun and the screen is minimum, and in the same manner, the magnification of the electron lens can be made small, and the stop on the screen can be made small, thereby an image having high resolution can be formed. At the same time, the depth of the display device can be shortened. Since the screen is flat, an image having extremely good visibility can be formed on the screen. In addition to these advantages, there can be provided a display device having high practical use and high industrial value.

Moreover, in the display device of the present invention, the display segment regions, which correspond to the screen of the plurality of independent picture tubes, are formed in the inner surface of the flat faceplate, and a plurality of openings is formed in the rearplate, and support members are arranged between the plates to ensure the interval between these plates against atmospheric pressure. Also, the funnel is continuous from the opening of the rearplate, and the neck portion is continuous from the funnel. By use of the flat rearplate having the opening, the support members can be arranged in the flat rearplate other than the opening, and extremely simple structure can be obtained. Moreover, since the distance between each electron gun, which is an electron source, and the screen can be made minimum and set in the same manner, the magnification of the electron lens can be made small, and the beam stop on the screen can be made small, and an image having high resolution can be obtained. At the same time, the depth of the display device can be shortened. Since the screen is flat, an image having extremely good visibility can be formed on the screen. Moreover, similar to the structure in which the plurality of normal picture tubes is arranged, the structure is considerably simple, and the support members are provided, so that the faceplate and the rearplate can be thinned and the weight of the display device can be reduced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

An embodiment of the present invention will be explained with reference to the drawings.

Figure 6:
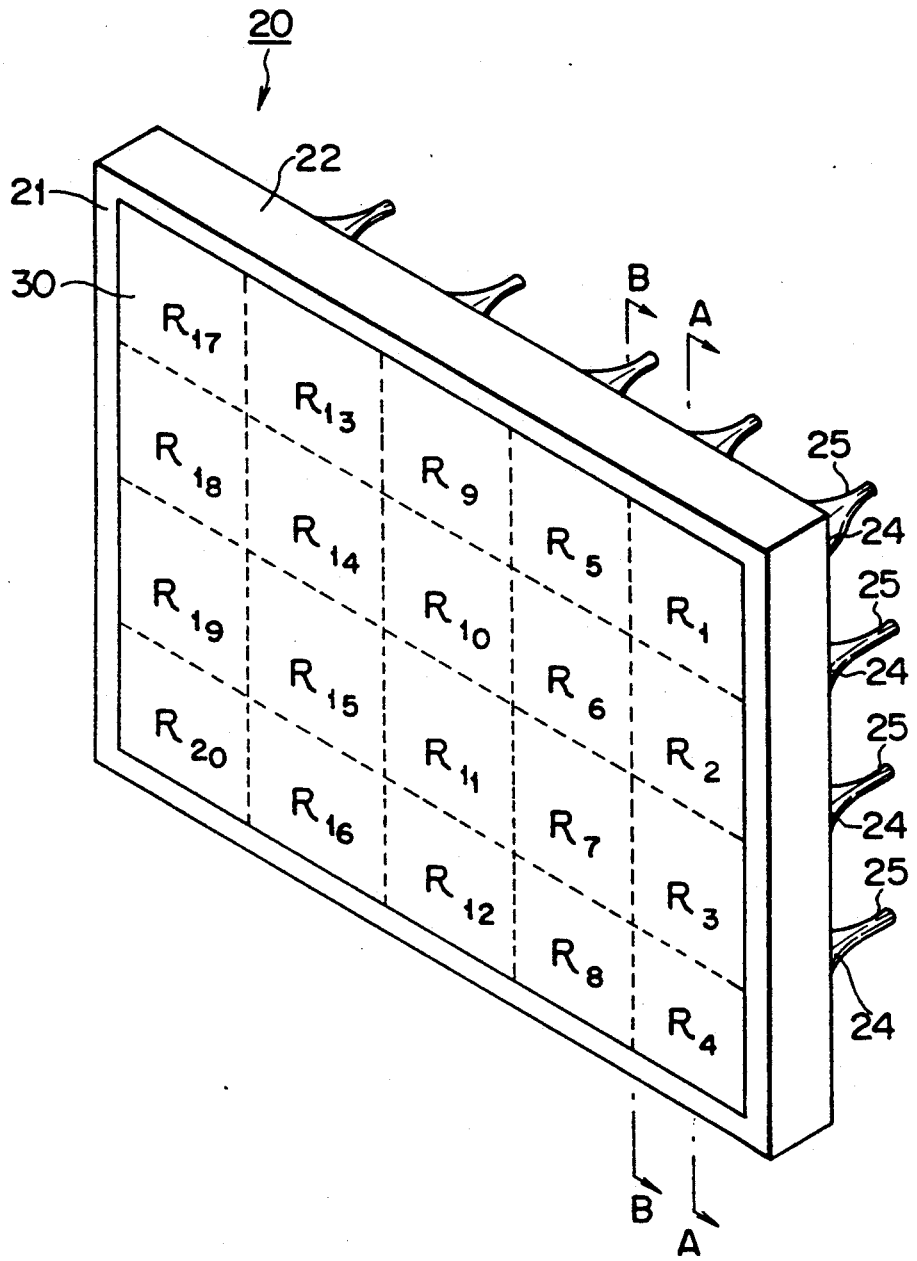
FIG. 6 is a perspective view showing a cathode-ray tube display device relating to an embodiment of the present invention.
Figure 7:
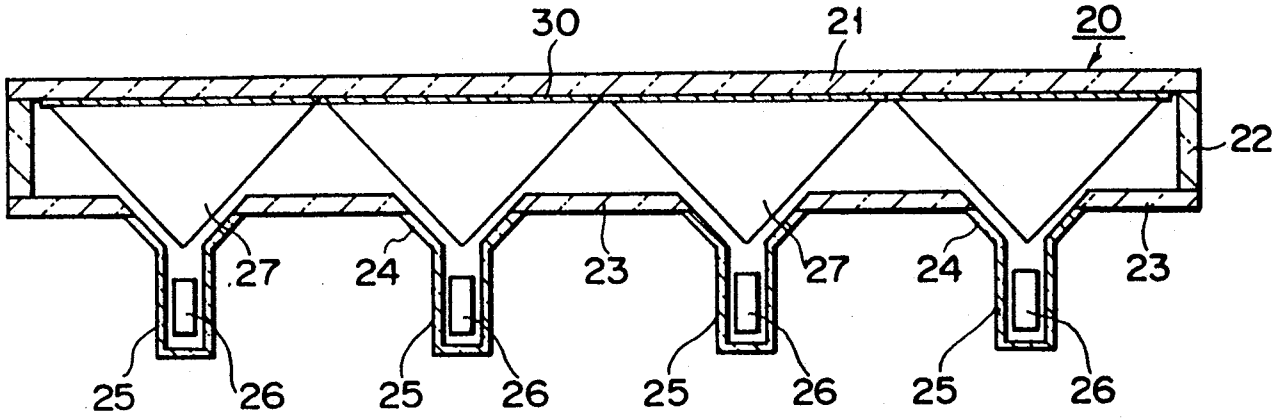
FIG. 7 is a perspective view of the cathode-ray tube cut along line A—A and seen from an arrow direction.
Figure 8:
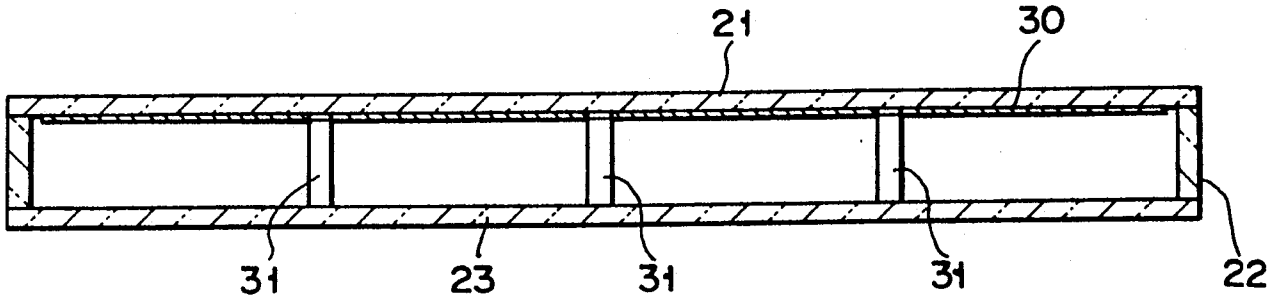
FIG. 8 is a perspective view of the cathode-ray tube cut along line B—B and seen from an arrow direction.
Figure 9:
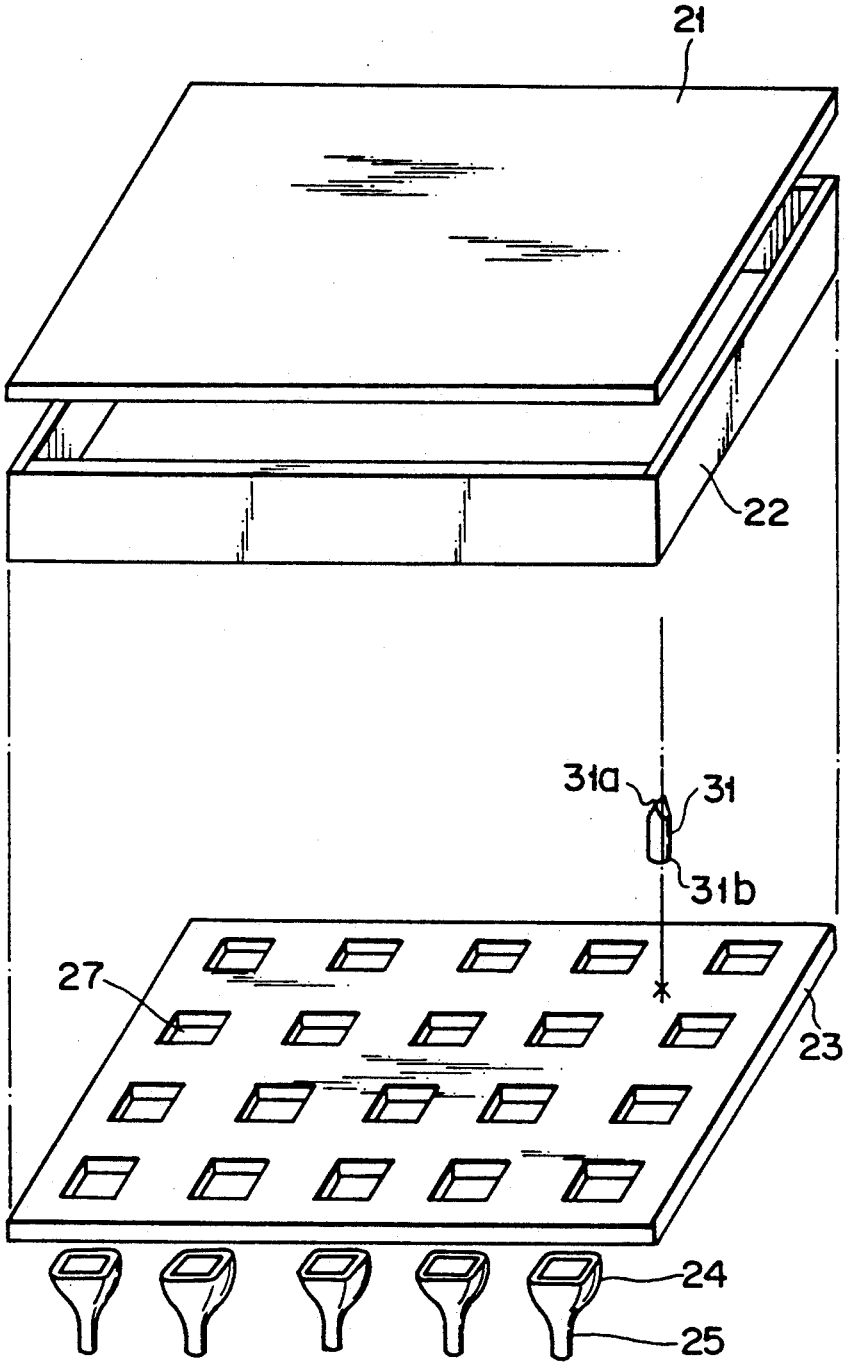
FIG. 9 is a perspective view showing a exploded main part of the display device of FIG. 6.
Figure 10:
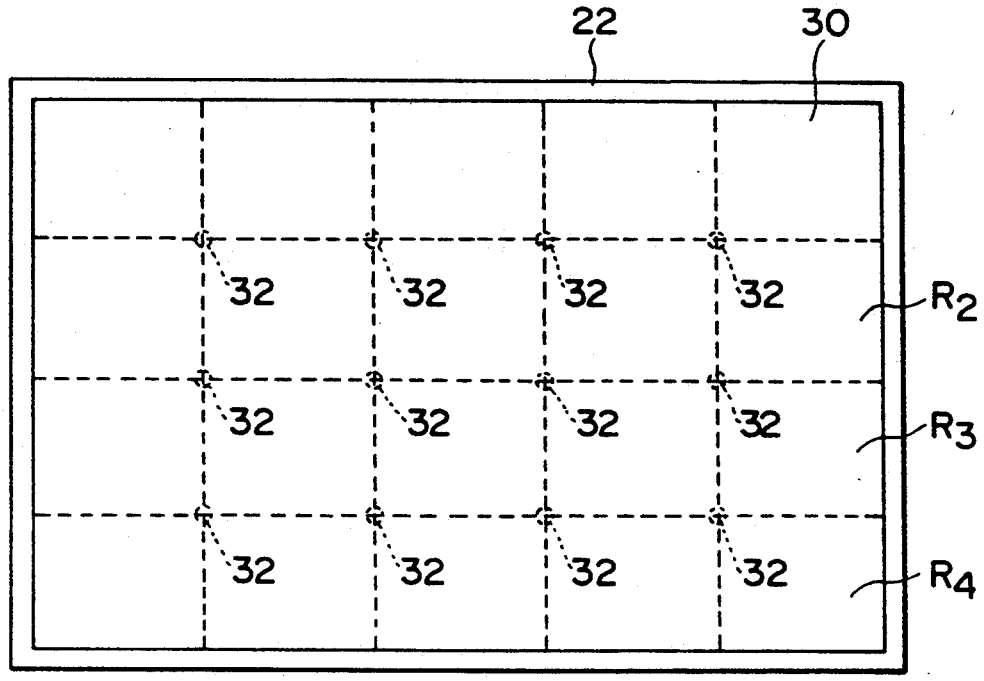
FIG. 10 is a plane view showing a screen of the display device of FIG. 6.

FIGS. 6 to 10 show a cathode-ray tube type display device of an embodiment of the present invention. FIG. 6 is a perspective view showing the entire structure, and FIGS. 7 and 8 are cross sectional views of FIG. 6. A display device 20 comprises a vacuum envelop including a flat faceplate 21, a side wall 22, which is provided around the faceplate 21 and extends in a direction, which is substantially perpendicular to the face plate, a rearplate 23 opposing to the faceplate 21, a plurality of funnels 24 and a plurality of necks 25, which are continuous to the rearplate 23. In each neck 25, there is enclosed an electron gun assembly 26 generating single red, green and blue, electron beams. In the vicinity of the electron gun assembly 26, there is arranged a deflection device (not shown). The faceplate 21 is formed of flat glass, and a monochromatic fluorescent layer or color fluorescent layers is formed on the faceplate 21, thereby forming a fluorescent screen 30. The electron beam emitted from each electron gun assembly, is deflected and scans the fluorescent layer so that light rays are emitted from the fluorescent screen 30. Then, rasters R1, R2, R3 . . . R20, which correspond to small segments each having substantially the same size, are drawn. These small raster regions are connected by a signal applied to the electron guns and the deflection device, and one large raster is formed on the entire screen. As shown in FIG. 7, the rearplate 23 is also formed of glass, an opening 27 is formed at a predetermined position, and the funnels 24 are bonded to the rearplate 23 around the openings 27. In the vicinity of the openings 27, there are fixed support rods 31, serving as support members, as shown in FIG. 9. A top end portion 31*a* of the support rod 31 is wedge-shaped, and the thin flat faceplate 21 and the rearplate 23 are supported at a predetermined interval against atmospheric pressure. As shown in FIG. 10, the support rod 31 is positioned at the portion between the adjacent segment regions, that is, a crossing point 32 of the boundary lines between the rasters regions of the screen.

As mentioned above, high atmospheric pressure is applied to the vacuum envelop comprised of the flat faceplate 21, the side wall 22, which extends in a direction substantially perpendicular to the faceplate 21 from the periphery portion of the faceplate 21, and the rearplate 23, which is faced to the faceplate 21 and arranged substantially parallel to the faceplate 21 at a predetermined interval. For example, in a faceplate having a size of 20 inches, a force of 1 ton or more is applied to the entire surface of the faceplate. In order to withstand such a high atmospheric pressure, the number of support members can be increased to obtain greater stability. However, this is unfavorable in terms of productivity, and a life characteristic is deteriorated, because of difficulty in dealing with occluded gas.

In consideration of the above-mentioned points, regarding the display device having sufficient strength against atmospheric pressure without deteriorating an image characteristic, the inventors of the present invention carried out simulations which are explained later. They studied the relationship between the thickness of the faceplate and the interval of the adjacent support members, and found out that a ratio t/P should be set to 0.05 or more where the thickness of the faceplate is t and the interval between the adjacent support members is P.

Figure 11:
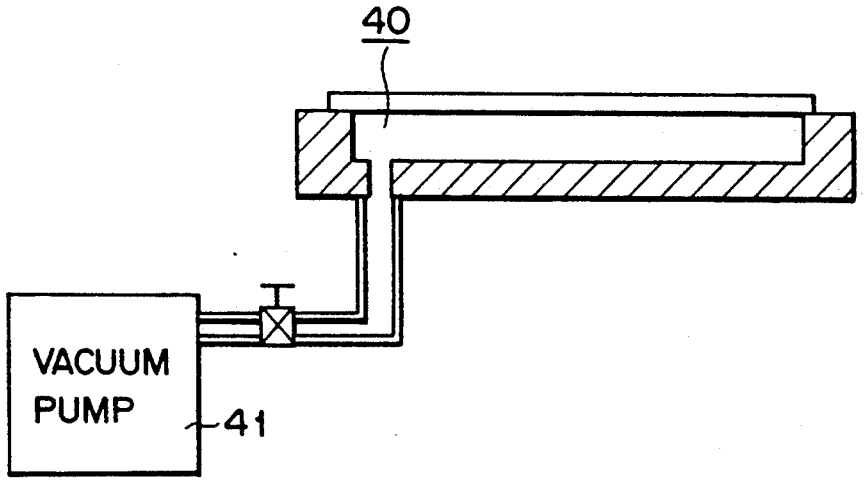
FIG. 11 is a cross sectional view of a vacuum device for vacuuming an envelope provided with a flat glass faceplate to test a withstanding pressure of the flat glass faceplate.
Figure 12A:
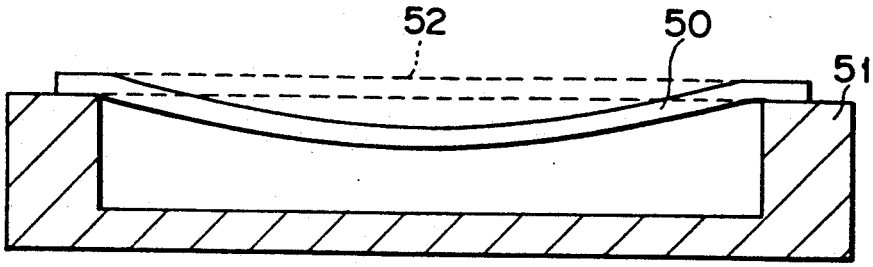
FIGS. 12A, FIG. 12B, and FIG. 12C are schematic cross sectional views showing a modification of a glass faceplate.
Figure 12B:
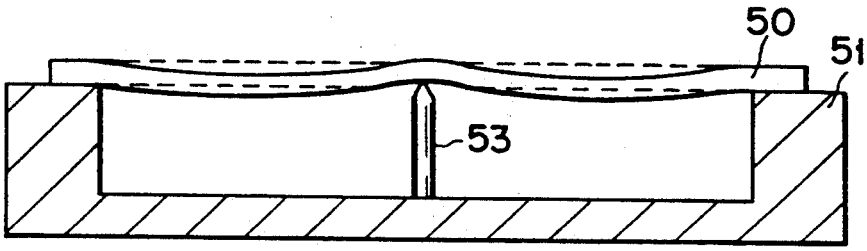
Figure 12C:
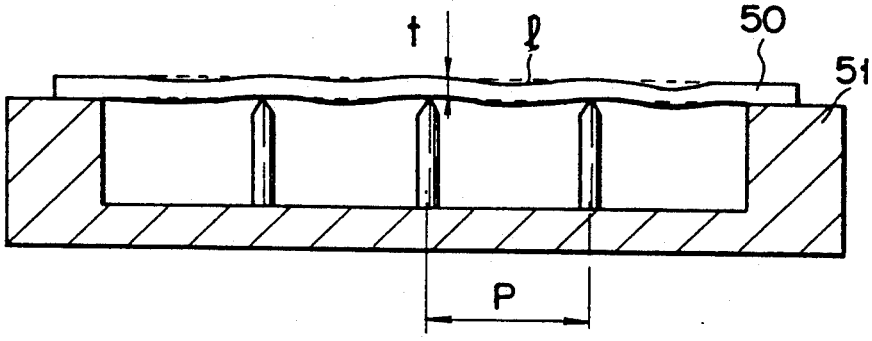

The inventors studied the stress characteristic of the atmospheric pressure on the flat glass faceplate by an experiment using a rectangular vacuum device 40 whose inner size is 300 mm in length and 400 mm in width shown in FIG. 11 and computerized stress simulations. As a result, in a case where glass has the size corresponding to 20 inches, that is, diagonal distance of 500 mm, glass is destroyed by atmospheric pressure under vacuum if the thickness of the plate is not set to 15 mm or more. If a vacuum pump 41 is operated and the space between glass plate of the vacuum device 40 and the vacuum pump 41 is exhausted, glass 50 is curved from a mounting position 52 on a support frame 51 as shown in FIG. 12A, so that the thin glass plate cannot withstand atmospheric pressure without support members. In a vaccum envelop of a cathode-ray tube, having a spherically curved glass faceplate, even if the central portion is formed in thickness of 12 to 13 mm, the thickness of the peripheral portion is over 20 mm. Moreover, the peripheral edge is tightened by a tension band, and the maximum stress is designed to be about 1000 PSI (pound per square inch). Thereby, the envelop is prevented from being destroyed. This point also explains that the thickness of glass plate must be 12 to 13 mm or more in a case where no support members is provided. As shown in FIG. 12B, if one rod support members 53 is arranged on the central region of the glass plate, glass plate 50 is curved as shown in the drawing. In this case, glass plate can withstand atmospheric pressure if the thickness is 10 mm or more. As shown in FIG. 12C, if nine support members 53 are arranged on the center region and mid-region of the glass plate, deformation of glass is further reduced, glass plate can withstand atmospheric pressure if the thickness is 4.5 to 5 mm or more.

Figure 13:
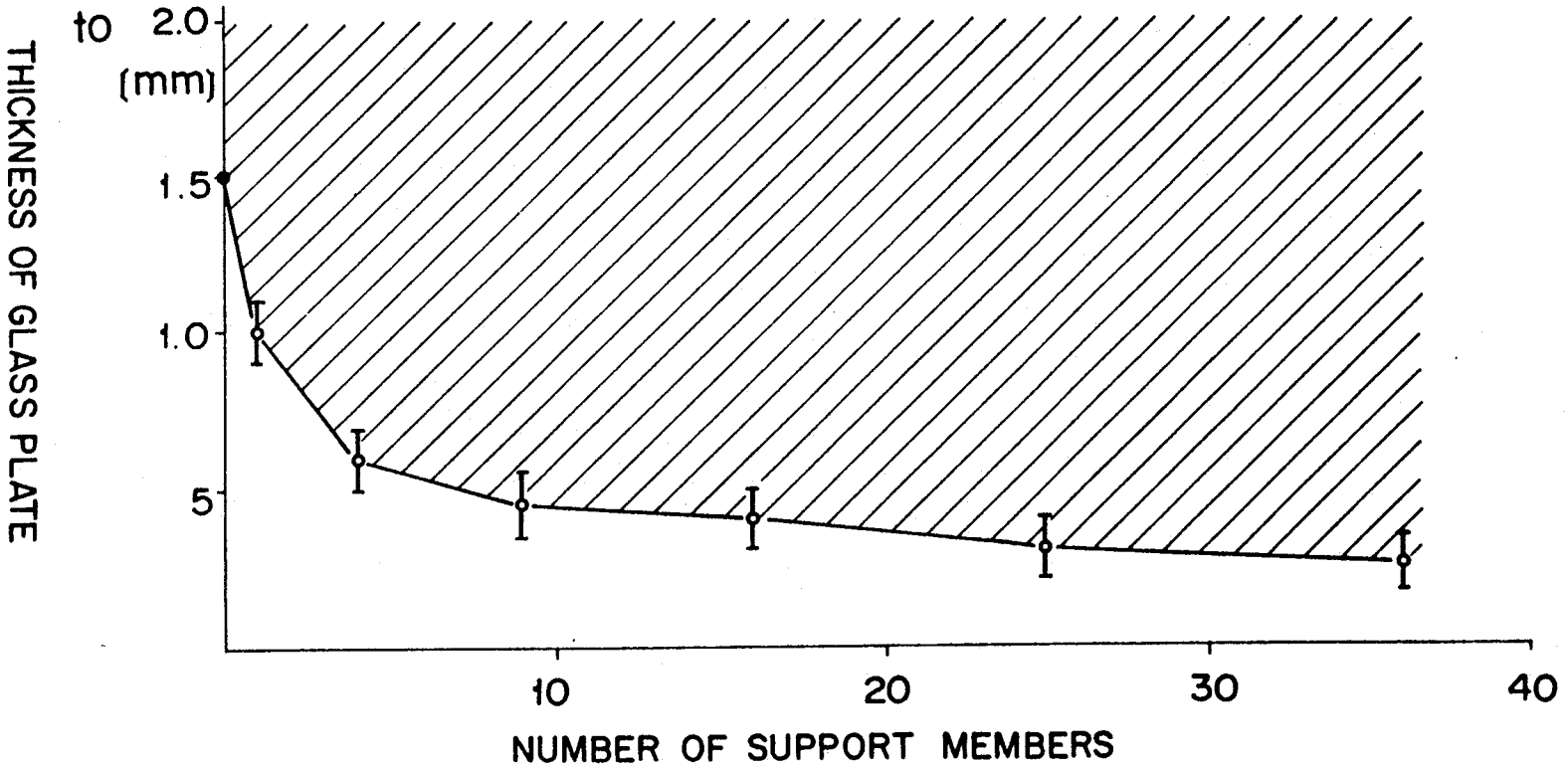
FIG. 13 is a characteristic view obtained by simulating the relationship between the number of support members in the display device of FIG. 1 and the thickness of the glass faceplate.

However, even if the number of support members is further increased, the thickness of the glass plate cannot be reduced in proportion to the number of support members. As is obvious from FIG. 13 showing the relationship between the number A of support members, which are arranged in the device of FIG. 11 at equal intervals, and the thickness t of glass plate withstanding destruction, the limitation of the thickness, which can withstand atmospheric pressure was 2 mm. As shown in FIG. 13, if the relation ship between the number A of the support members and the thickness of glass is in the region shown by oblique lines, glass can withstand atmospheric pressure.

As shown in FIGS. 12A, 12B, and FIG. 12C, if the ratio t/P is larger than a predetermined value where the thickness of the faceplate 50 is t and the interval between the adjacent support members 53 is P, there is little amount l of deformation of faceplate 50, thereby no destruction due to deformation may occur. If the ratio t/P is smaller than the predetermined value, the amount l of deformation of the faceplate increases and destruction occurs. In order to withstand the inner deformation of glass, it is necessary to avoid generating much deformation, and the thickness of glass must be reserved to some extent.

Table 1 shows ratio t/P, which was calculated from the result of the experiment of FIG. 13.

TABLE 1

| Thickness t (mm) Members of Glass plate | Number of Support Members | Interval P (mm) between Support Members | Ratio t/P |
|---|---|---|---|
| 10 | 1 | 175 | 0.057 |
| 6 | 4 | 117 | 0.051 |
| 4.5 | 9 | 87.5 | 0.051 |
| 4 | 16 | 70 | 0.057 |
| 3 | 25 | 58 | 0.052 |
| 2.5 | 36 | 50 | 0.050 |

As is obvious from Table 1, ratio t/P of 0.05 or more is required in order that the sheet glass withstands atmospheric pressure.

In a case where the above-mentioned 20-inch-sized faceplate is used and the screen is divided into 5 vertical segment regions and 5 horizontal segment regions, the number of the crossing points of the segment regions is 16. Then, if the support members are provided on each crossing point, the number of support members is 16. In this case, since the horizontal size of the screen is about 400 mm and the vertical size thereof is about 300 mm, each divided segment region is about 80 mm in horizontal size and about 60 mm in vertical size, and the interval P between the adjacent support members is about 70 mm in horizontal and vertical sizes on the average. Therefore, if the thickness of glass faceplate is 4 mm, t/P is 0.057 and this can sufficiently withstand atmospheric pressure.

In a case where a 40-inch faceplate is used, the number of support members is 81 since the interval P between the support members is about 70 mm in horizontal and vertical sizes on the average when the thickness of the faceplate is 4 mm. Also, if the interval P between the support members is set double, that is, 140 mm, the total number A of support members may be 16, and the minimum thickness of glass faceplate is 7 mm. The selection of the thickness of glass faceplate and the number of support members can be determined in consideration of the total weight of the display device, dead load against the area of the faceplate, and impact resistance.

In the embodiment shown in FIGS. 6 to 10, there is provided a 20-inch faceplate having an aspect ratio of 3:4. The screen is divided into 5 horizontal segment regions and 4 vertical segment regions. Since 16 crossing points are provided and rod-like support members is provided on each crossing point, the number of support members is 12. Since the interval P between the adjacent support members is about 80 mm in the horizontal direction and about 75 in the vertical direction, 78 mm of average pitch is obtained. Therefore, t/P is 0.051 if the thickness of the glass faceplate is 4 mm. Even if the thickness is 5 mm in consideration of safety, if there can be achieved a vacuum envelope having light weight and sufficient strength enough to withstand the atmospheric pressure. Since the number of support members is only 12, the entire display device can be easily manufactured. Moreover, the discharge of occluded gas under vacuum can be ignored, and the life of the display device is not deteriorated.

Furthermore, in the embodiment, since the thickness of the faceplate is 5 mm, the weight of the faceplate is only about 1.8 kg. This is made much lighter than the same-sized faceplate of the conventional display device having weight of about 9 kg, and the weight of the entire display device is considerably lightened.

As mentioned above, according to the present invention, in a case where the cathode-ray tube having a flat glass faceplate is formed, the thickness t of the faceplate is 2 mm or more and the interval P between the adjacent rod-like support members is set to be a ratio t/P of 0.05 or more. Thereby, there can be obtained a stable and flat vacuum envelop. Moreover, since the number of support members is extremely small, large effect can be obtained in terms of the manufacture of the tube, and the life of the tube. Also, this can lighten the weight of the cathode-ray tube, thereby making it possible to easily manufacture a flat cathode-ray tube having high practical use.

The number of support members is preferably reduced in view of the operation of the tube. Since the peripheral edge of the faceplate is supported by the side wall of the vaccum envelope, resistance against atmospheric pressure at the pheripheral edge is higher than that of the central portion of the faceplate. When a distance between the side wall and the support member adjacent to the side walls is shorter than the interval between the support members on the central portion of the faceplate, the number of support members can be reduced. The number of support members can be also reduced if the thickness of the faceplate is made large. However, in consideration of the weight of the faceplate and that of the cathode-ray tube, the faceplate is preferably formed as thin as possible. Therefore, for example, the faceplate having a thickness of 15 mm or more is not favorable for practical use. Under this state, it is difficult to manufacture the glass faceplate utilizing a float method, and productivity worsens. Moreover, the effect of the present invention can be considerably brought about in a case in which the thickness of the faceplate is thinner than the conventional cathode-ray tube having no support members. The thickness of the faceplate is preferably 10 mm or less, and more preferably the faceplate has a thickness of about 5 mm, which is light in weight and favorable for practical use in view of the treatment.

In the cathode-ray tube having the screen which is dividedly scanned by the electron beams, as explained in the embodiment, the adjacent electron gun assemblies must be positioned so as to be separated by a certain extent. The interval, that is, the distance between center axes of the adjacent electron gun assemblies cannot be set to be 15 mm or less. In a case where the support members are arranged on the crossing points of the divided regions of the screen, the interval of the arrangement must be at least 15 mm or more. Therefore, in the embodiment of the present invention, it is difficult to realize the plate whose upper limit of the ratio t/P is over 1.0. The value of t/P by which the effect of the present invention is considerably brought about is 0.67 or less, and 0.33 or less is preferably.

Further, in the above embodiment, rod-shaped support members are used whose end portions are wedge-shaped. The top end portion can be needle-shaped. However, this is not favorable since the inner deformation of the glass faceplate increases in a concentrate manner at the portion of glass with which the needle-shaped portion comes into contact. Therefore, it is better to linearly lengthen the top end portion contacting glass. In a case where the screen is formed of a three-colored stripe fluorescent member including a black stripe, the top end portion of the support material is preferably arranged on the black stripe so that a non-emitting portion corresponding to the contacting point of the support members will not be conspicuous. However, since the width of the black stripe is only 100 um, it is difficult to accurately adjust the top end portion of the support member onto the black stripe. The longer the linear length of the contact portion, that is, the length in the longitudinal direction, the more difficult to adjust the top end portion of the support member on the black stripe. Moreover, when the top end portions of the support members are deformed by the change of temperature during the operation, the screen may be broken. Thus, linear length of the top end portion of the support members may be shortened without being integrated with the top ends of the adjacent support members in the longitudinal direction.

The above embodiment explained the structure wherein the funnels and the necks are connected to the rearplate shown in FIGS. 6 to 10 and the electron gun assemblies are provided in the necks respectively. Yet the present invention is not limited to the above-mentioned structure. More specifically, the present invention can be applied to the structure wherein the opposing two flat plates are supported by the support members. For example, in a case where there is used a display device wherein a linear wire-shaped cathode and an electrostatic deflection are combined, the lower limit value of the interval between the support members in the structure of the electron gun can be further reduced as shown in the above embodiment. As a result, the range of ratio t/P widens. In the present invention, ratio t/P may be suitably set in accordance with the structure of the display device to be used.

Next, there will be explained a 20 inch display device relating to the other embodiments of the present invention.

Figure 14:
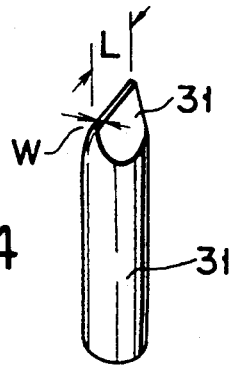
FIG. 14 is a perspective view showing the shape of the support members applied to the display device of the present invention.

In the second embodiment, the entire structure is the same as the structure explained in the first embodiment shown in FIGS. 6 to 10. In the entire surface of the screen 30, the interval between the faceplate and the rearplate is 20 mm, and the height of the support members 31 shown in FIG. 14 is 20 mm. Regarding the support members 31, the top end portion of a metal round bar having a diameter of 15 mm is wedge-shaped by a mechanical process. There is formed a wedge-shaped top end portion 31*a* whose a width W is 0.05 mm and a length L in the longitudinal direction of the top end portion is 15 mm, which is the same size as the diameter of the metallic round rod. The wedge-shaped top end portion 31*a* contacts a black stripe of the screen 30 and the width of the black stripe is 0.07 mm.

In this embodiment, the size of the fluorescent screen 30, which is formed on the inner surface of the faceplate 21 is about 400 mm × 300 mm, and atmospheric pressure applied to the faceplate 21 is supported by 12 support members 31.

Discussed now are the result of reviewing a stress distribution of the faceplate when the wedge-shaped top end portion 31*a* of the support members 21, which is the main part of this embodiment, contacts the faceplate 21 and atmospheric pressure is applied.

Regarding the strength of the stress when atmospheric pressure is applied to the faceplate, there are first and second destruction factors. The first destruction factor is determined by the relationship between the thickness of the glass faceplate and the interval of the support members 31 as shown in the first embodiment. The second destruction factor is determined by the shape and size of the top end portion of the support members 31 and to be explained later. In the first factor, the faceplate is deformed by atmospheric pressure in its relatively large region between the adjacent support members. By this deformation, stress in compression is generated in the outer surface of the faceplate, and stress in tension is generated in the inner surface of the faceplate. Stress destruction occurs when the stress in tension exceeds a critical value. In the second factor, stress destruction occurs by stress in tension, which concentratively generates in glass in the vicinity of the top end portion of the support members 31 when the faceplate 30 contacts the support members. Generally, such deformation does not widely occur in the entire glass, but partially occurs in only one face of the inner surface side where the support members 31 contacts. In order to prevent the destruction in the second factor, it is preferable that the area where glass and the support members are in contact with each other is widened and an amount of load per a unit area is made small, thereby the amount of partial deformation is reduced. However, as mentioned in the prior art, there are various problems in increasing the area of the top end portion of the support members 31, and it is difficult to increase the area of the region. In consideration of the above point, the inventors found out that the increase in the contacting area of the top end portion of the support members 31 is kept to a minimum and the shape of the top end portion of the support members is efficiently formed.

Regarding stress, which is concentratively generated in one surface of the sheet glass, a contour line (equivalent stress line) of the maximum stress, which is close to the portion where the support members and the sheet glass are in contact, is obtained by a calculator simulation using a finite element method. Then, a state of stress concentration can be determined from the degree of the density of the pitch of the contour line. Moreover, in this type of calculator simulation, it is extremely difficult to accurately calculate an absolute value of the stress of the contact portion between the top end portion and glass. Also, such an absolute value is meaningless in the estimation of the stress concentration and the stress distribution. Therefore, the state of stress concentration from the stress distribution close to the periphery of the contact portion is a relative value comparison. The state in which glass is broken by the stress concentration is that where equivalent stress lines having high values are distributed to one point with close pitches. In this case, the sheet glass is load on one point and becomes deformed even if the top end portion of the support members has a certain degree of the length. Therefore, the state of the sheet glass can be discriminated by looking at the state of equivalent stress line whether the sheet glass is supported at one point or on the line having a certain area.

According to the above method, the inventors obtained the necessary minimum length by variously changing the length of the contact portion (length in the longitudinal direction of the top end portion of the support members) for holding atmospheric pressure to be applied to the sheet glass on the line having a certain area.

In the above simulation, the length L in the longitudinal direction of the top end portion was changed and calculated in a case in which the width of the top end portion of the support members was 0.05 mm. FIGS. 15A to 15F and FIGS. 16A to 16F are views showing the stress distributions obtained by the above simulation. There are provided 12 types of lengths L (0 to 20 mm) in the longitudinal direction (length 0 mm is a case wherein the sheet glass is supported on one point).

Figure 15A:
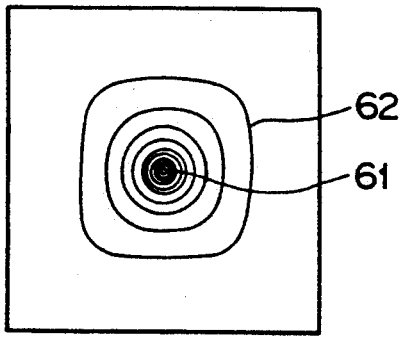
FIGS. 15A, 15B, 15C, 15D, 15E and 15F are stress distribution views obtained by simulating a stress distribution of glass when the support members comes into contact with glass.
Figure 15B:
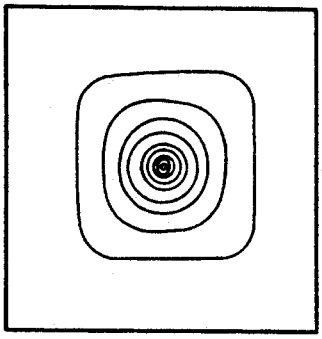
Figure 15C:
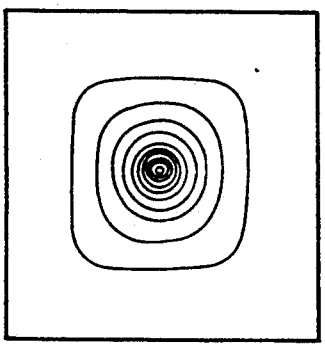
Figure 15D:
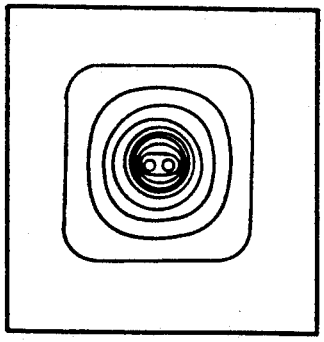
Figure 15E:
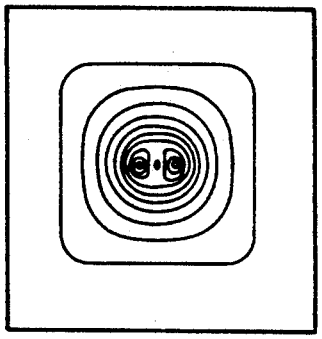
Figure 15F:
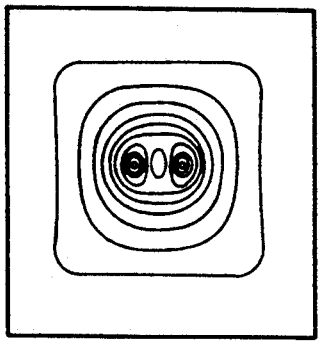
Figure 16A:
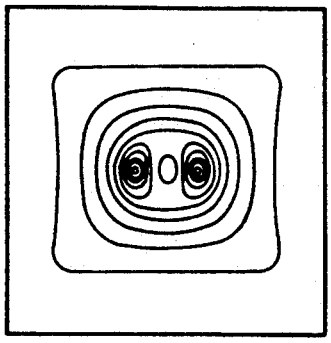
FIGS. 16A, 16B, 16C, 16D, 16E and 16F are stress distribution views obtained by simulating a stress distribution of glass when the support members comes into contact with glass.
Figure 16D:
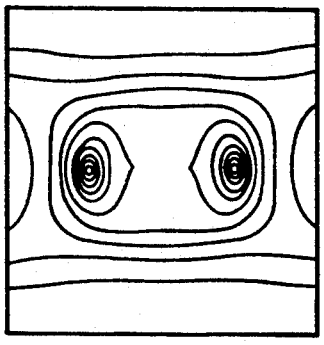
Figure 16B:
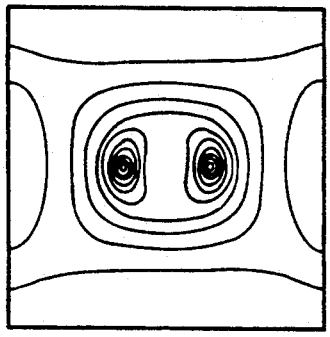
Figure 16E:
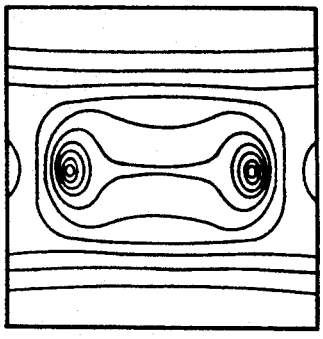
Figure 16C:
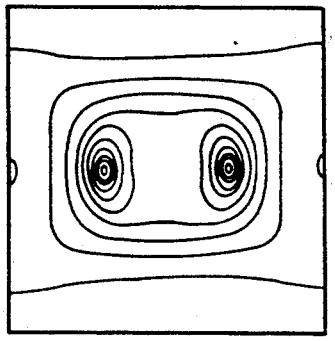
Figure 16F:
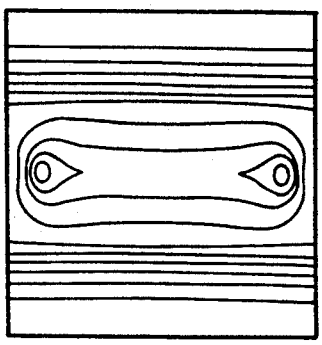

As is obvious from the stress distribution views of FIGS. 15A to 15F and 16A to 16F, in a case where the length in the longitudinal direction of the top end portion of the support members 31 is below 2 mm (support on one point, 0.5 mm and 1 mm) as shown in FIGS. 15A, 15B and 15C, the stress concentrates on substantially one point 61 (small area), and the pitches of the equivalent stress line are narrow, and it is understood that the abrupt concentration is performed. On the other hand, as shown in FIG. 15D, the stress is smoothly distributed to have a relatively large area at the time when the length in the longitudinal direction exceeds 2 mm. More specifically, in the stress distribution views in which the length is 0 mm, 0.5 mm or 1 mm, one equivalent stress line having the highest stress value appears as a small circle in the central portion corresponding to the top end portion. Therefore, it can be understood that the support members 31 having such a length of the top end portion functions similar to the support members 31 having the dot-like top end portion. In the stress distribution view in which the length is 2 mm, two equivalent stress lines having the same size appear in parallel in the portion corresponding to the top end portion. It can be understood that there is a tendency for the stress of one point concentration type to be relaxed. Moreover, in the stress distribution view in which the length is 3 mm, it can be understood that concentration of two equivalent stress lines, which are symmetrically distributed in the top end portion, are completely divided. Therefore, in order to hold the load due to atmospheric pressure by use of the support members 31 whose top end portion is wedge-shaped, the length in the longitudinal direction of the top end portion of the support members must be at least 2 mm or more. Moreover, the stress in which the length in the longitudinal direction is 2 mm or more becomes smooth in accordance with the length in the longitudinal direction as mentioned above. Further, the absolute value of the stress decreases as the contact area between the sheet glass and the support members increases.

The inventors found out from the result of the calculator simulation that the minimum value of the length in the longitudinal direction of the top portion of the support members to effectively hold atmospheric pressure was 2 mm. However, in consideration of the practical use and safety, it is preferably that the length of the top end portion is set to be slightly longer.

It is noted that the width of the top end portion of the support members was set to 0.05 mm in the result of the calculator simulation shown in this embodiment. However, the similar result was obtained in the case in which the width of the top end portion was up to at least 0.5 mm.

In contrast, the process of the support members and the assembly become difficult as the length L of the top end portion in the longitudinal direction is made longer. Regarding the processing of these support members, since it is necessary for the top end portions to contact the surface of the sheet glass in parallel, the degree of parallel of the top end portions is extremely important. Then, since it is difficult for the extremely long top end portions in the longitudinal direction to be processed, the maximum length is 30 mm in view of practical use, that is, productivity. Moreover, in consideration of the forming accuracy, a long member of the top end portion in the longitudinal direction is unfavorable. Regarding the assembly, since the top end portions must be arranged on the black stripes, the accuracy of position and the degree of parallel between the black stripe and the longitudinal direction of the top end portions are extremely important at the time of assembly. The accuracy limit at the time when the normal support members are assembled in parallel is 0.02° for practical use. Moreover, if the the length of the top end portion of the support members is about 30 mm or more, the assembly of the support members becomes considerably difficult.

In the embodiment of the present invention, the top end portion of each support members is wedge-shaped and formed of a relatively thick metallic round rod. Therefore, the area contacting the rear panel is large, and these support members can be relatively easily assembled with high accuracy.

Figure 17A:
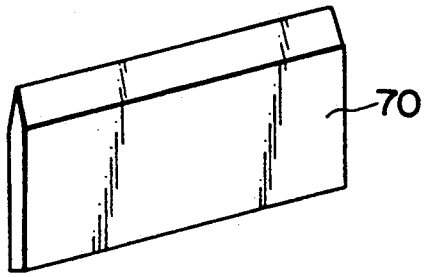
FIGS. 17A and 17B are perspective views showing the other examples of the support members applied to the display device of the present invention.
Figure 17B:
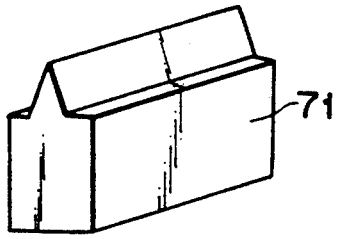

As shown in FIG. 14, each support member of the above embodiment has the cross section of the end portion 31*b* of the rear side, which is circular in form, and the end portion 31*a* is formed into a wedge-shape. However, for example, as shown in FIGS. 17A and 17B, a plate-like support member 70 or a square timber-like support members 71 may be used, or the support members are partially or wholly connected to the other members. If the top end portion of the support member is wedge-shaped and has a length of 2 to 30 mm in the longitudinal direction, the function of the present invention and the effect can be exerted.

Furthermore, the present invention can be applied to a case in which a plurality of support members are partially or wholly integrated.

In the above embodiment, metal is used as a material for the support members. However, glass and ceramic may be applied to the present invention.

The above embodiment explained the cathode-ray tube having the necks in which electron gun assemblies are received, respectively. However, the present invention is not limited to the above-mentioned structure. It may further be applied to a structure in which two opposing flat plates are supported by support members. One such example is a display device in which a linear wire cathode and electrostatic deflection are combined.

The other embodiments having the same structure of the first embodiment shown in FIGS. 6 to 10 will be explained.

In a third embodiment, as shown in FIG. 9, a flat glass material is used as a rearplate having a substantially rectangular opening 27 formed at predetermined position. The opening 27 can be formed by a method in which abrasive composition is blown with high pressure air or high pressure water, a method using laser-melting, a method using ultrasonic wave, or a method using a grinding stone. According to these methods, the opening can be easily formed at an ordinary temperature. It is possible to form the opening 27 by a secondary forming method in which glass is heated at over a glass softening point. Moreover, a press-forming can be used in forming the opening 27.

Faceplate 21, rearplate 23, and side wall 22 are formed of glass plates, which are all the same thickness and the same material. Funnel 24 is formed by a blowing method. Regarding the bonding of these respective members, a melting method can be used in the necks 25, the funnels 24, and the rectangular side of the side walls 22, frit glass is used in the other portions.

One faceplate, four side walls, one rearplate, and a plurality of funnels and the necks are formed of all glass plates. Thereby, there can be provided a display device whose total depth is shorter without using the faceplate and the rearplate, which have curvature as in the conventional cathode-ray tube.

Moreover, atmospheric pressure is supported by the support members 31 and sufficient strength can be obtained by relatively thin glass material raging from 4 mm to 15 mm, which is preferable for weight and strength. Due to this, the weight of the cathode-ray tube is considerably lighter than than that of the conventional cathode-ray tube. Further, deformation of the plates due to atmospheric pressure can be made extremely small by use of the support members 31. The amount of deformation is zero at the position where the support members are provided, and maximum at the center of each divisional scanning region. The amount of deformation is substantially symmetrically distributed relative to the center. The central axis of the electron gun, which is arranged on the extended line of the center of the deformation, is not completely inclined after deformation. Therefore, the central axis of the electron gun can be maintained to be perpendicular to the screen. Thus a structure can be formed which has no deformation influence on the envelop which cannot be realized in the conventional cathode-ray tube having no support members. Therefore, an image having extremely high definition and stability can be reproduced. In the display device of the present invention, the support members must be arranged on the boundary line of the each divisional scanning region where shadow and reflection are not generated by the support members, even if the electron beam is deflected and scanned.

According to the above embodiment, the support members are used as mentioned above, deformation of the envelop due to atmospheric pressure can be made extremely small, and the distribution of deformation in each divisional scanning region can be made to be substantially symmetrical to the center of the region. As a result, the central axis of the electron gun can be arranged to be perpendicular to the fluorescent surface in any regions. This is an extremely large disadvantage for the cathode-ray tube having an electron beam generating section in the rearplate.

Moreover, since the distance between the electron gun and the fluorescent screen can be relatively easily shortened, magnification of the electron lens can be made smaller, and an image having high resolution can be easily displayed. Further, since glass is used as a rearplate in the structure of the present invention, a space through which the electron beam passes can be more easily made to be a equipotential space having high potential than a structure using a metallic plate. Therefore, unlike the metallic plate, there is no need for the entire rearplate to be insulated. Moreover, it is possible to prevent the mutual interference that ocurs when the magnetic field of the adjacent deflection vehicle is generated through the metallic plate.

According to the above embodiment, there is formed a plurality of rectangular openings 27 at a predetermined position of the rearplate 23. The rectangular openings 27 are not necessarily rectangular. Instead, the shape of the opening is preferably an outermost track of the electron beam, that is, raster-shape in order to lower the consumption of electric power of the deflecting yoke, which is attached to the outer wall of the funnel 24 connected to the opening. In the present invention, the openings are formed in the flat rearplate, and the funnels and the necks are connected to the openings. Due to this, it is possible to largely reduce the consumption of electric power of the deflection device by thinning the glass of the funnel, which cannot be done in the conventional cathode-ray tube. Moreover, by use of the above-mentioned rectangular-shaped openings, consumption of electric power can be further reduced. Also, in the above-mentioned embodiment, in addition to the method for reducing the consumption of electric power, an inclination is formed in the openings, and the distance between the electron beam, which passes through the outermost portions of openings, and the glass wall surface, is shortened, thereby realizing a smaller-sized deflection device having a lower consumption of electricity. Also, there can be reduced mutual interference of the magnetic field generated between the adjacent deflection devices, and there is a large advantage therein. Moreover, there is an advantage in that spaces for arranging the inner structure such as supporting members can be widely reserved.

The above embodiment explained the structure in which the rearplate and the funnels and the necks were separately formed and these members were enclosed. The present invention is not limited to the above embodiment. It is possible to integrally form the rearplate, and the funnels and the necks.

A fourth embodiment will be explained. The entire structure of the fourth embodiment is similar to the above-mentioned embodiment, as shown in FIGS. 6 to 10, there are arranged the rod-shaped support members 31 as support members between the faceplate 21 and the rearplate 23. The top end portion 31*a* of each support members 31 is wedge-shaped, and the base portion 31*b* is adhered to the portion if the rearplate to which the funnel are connected. These support members are used to support the faceplate and the rearplate from atmospheric pressure. If there is used a color cathode-ray tube screen wherein striped absorbing materials, such as black strips are formed between the striped fluorescent members, the wedge-shaped top end portions may be arranged along the striped absorbing materials.

Figure 1A:
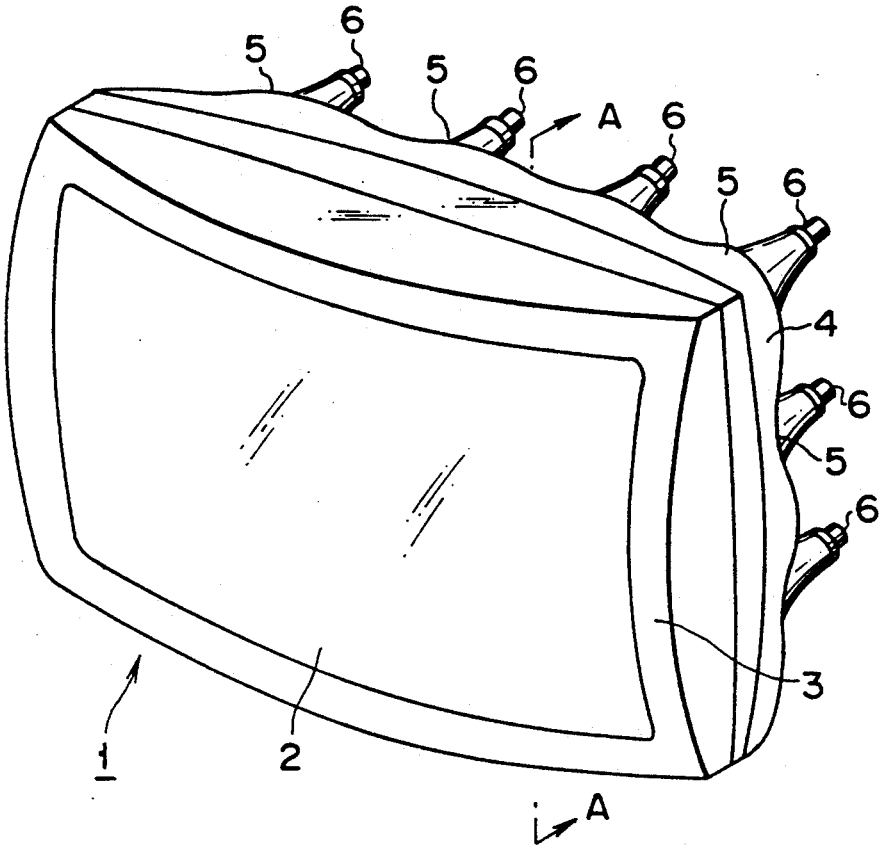
FIG. 1A (PRIOR ART)
FIGS. 1A and 1B show a perspective view and a cross sectional view showing a conventional cathode-ray tube which represents a typical class of prior art.
Figure 1B:
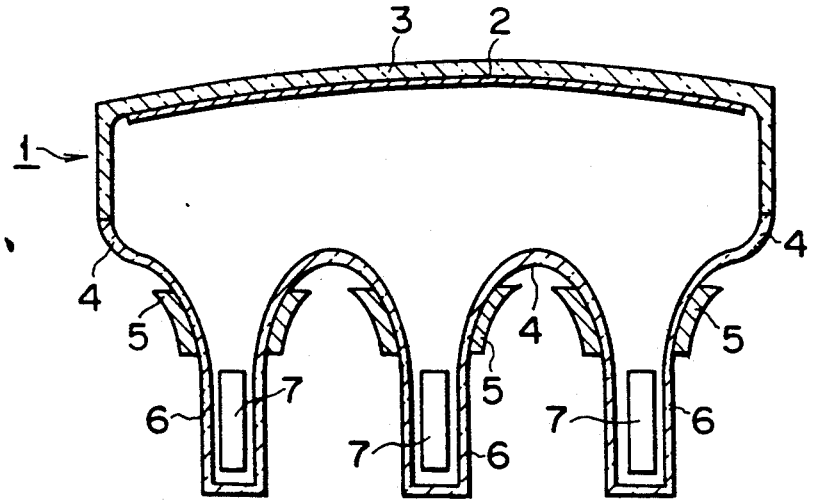
FIG. 1B (PRIOR ART)
Figure 2:
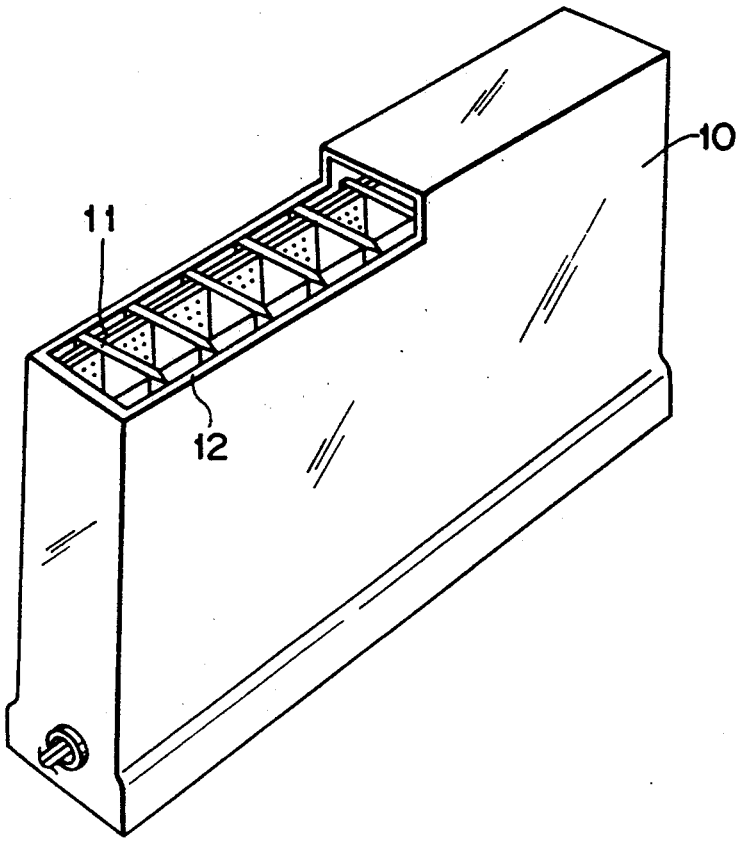
FIG. 2 (PRIOR ART)
FIG. 2 is a partially cutaway cross sectional view showing the other conventional display device representing a second class of prior art.
Figure 3:
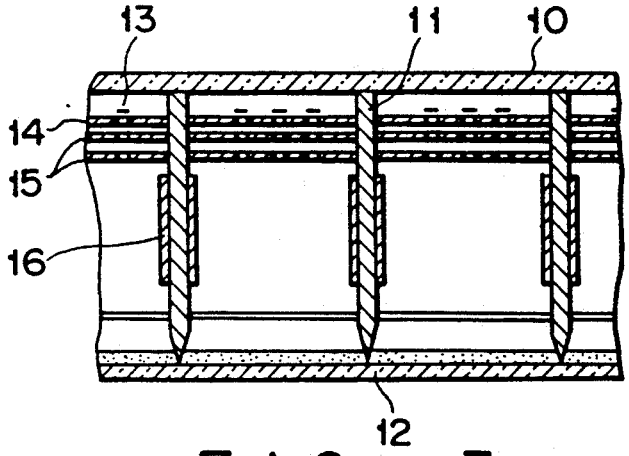
FIG. 3 (PRIOR ART)
FIG. 3 is a partially enlarged cross sectional view showing the display device of FIG. 2.
Figure 4:
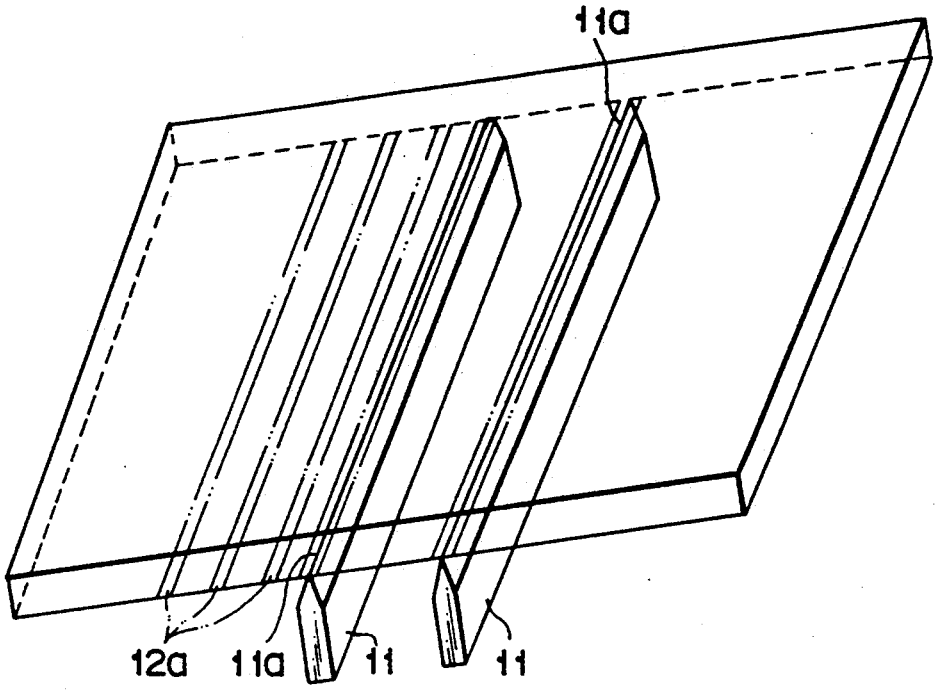
FIG. 4 (PRIOR ART)
FIG. 4 is a schematic view explaining a state that support members of FIG. 2 contact a screen.
Figure 5:
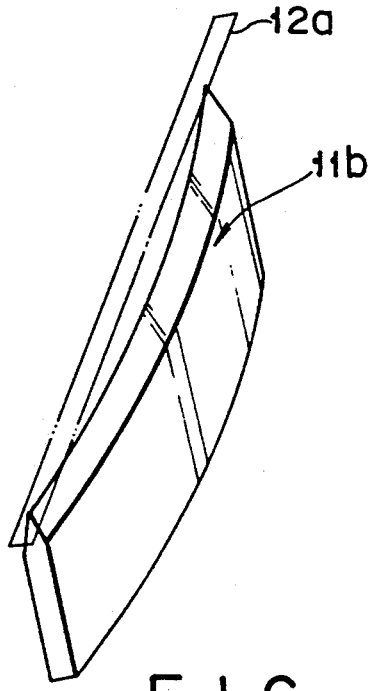
FIG. 5 (PRIOR ART)
FIG. 5 is a schematic view explaining a modification of the support members of FIG. 4.

The size of the fluorescent screen 30, which is formed in the inner surface of the faceplate 21, is about 400 mm×300 mm, and atmospheric pressure to be applied to the faceplate is supported by 12 support members 31. The top end portions of the support member contact crossing points 32 on the boundary lines between the divided segment regions R1 . . . of the screen as shown in FIG. 5, and the total number of the crossing points is 12.

As mentioned above, strong atmospheric pressure is applied to the entire vacuum envelop. If the number of the support members is increased, high stability can be obtained. However, this is not favorable in view of productivity, a treatment of occluded gas, and the life characteristic.

As explained above, regarding the strength when atmospheric pressure is applied to the faceplate, there are first and second destruction factors. The first factor is determined by the relationship between the thickness of the glass faceplate and interval of the support members. The second factor is determined by the shape and size of the top end portions of the support members. In the first factor, the faceplate is deformed by atmospheric pressure in its relatively large area of the region between the adjacent support members. By this deformation, stress in compression is generated in the outer surface of the faceplate, and stress in tension is generated in the inner surface of the faceplate. Stress destruction occurs when the stress in tension exceeds a critical value. In the second factor, stress destruction occurs by stress in tension, which concentratively generates in glass in the vicinity of the top end portions of the support members when the faceplate contact the support members. Generally, such deformation does not widely occur in the entire glass, but partially occurs in only one face of the inner surface side where the support members contact. Therefore, the positional interval between the thickness of the faceplate glass and the support members, and the shape of the top end portions of the support members when the faceplate glass is in contact with the support members are suitably set, thereby there can be provided a display device having sufficient strength against the above two destruction factors.

In this embodiment, since thickness of the 20 inch-sized faceplate having an aspect ratio 3:4 is 5 mm, the weight of the faceplate is only about 1.8 kg, and is considerably lightened as compared with the case in which the faceplate of the conventional tube having the same size is about 9 kg. Then, the entire weight of the cathode-ray tube is considerably lightened.

Moreover, the screen is divided into five in horizontal sections and four vertical sections. Therefore, crossing points 32 of the divided regions R1 . . . of the screen shown in FIG. 10 are 12, and the rod-shaped support members are provided in these portions. Therefore, the number of support members is 12. The interval P between the support members is about 80 mm in a horizontal direction and about 75 mm in a vertical direction, and the average interval is 78 mm. Therefore, ratio t/P is 0.064.

The interval between the faceplate 21 and the rearplate 23 is 20 mm in the entire surface of the screen 30, and the height of the support members are also 20 mm. The top end portions of the support members 31, which are formed of metallic-round rods having diameters of 15 mm, are wedge-shaped by a mechanical process. The widths W of the wedge-shaped top ends 31*a* are 0.05 mm, and the lengths L of the top end portions in the longitudinal direction are 15 mm, which is the same as the diameter of the metallic-round rod. The wedge-shaped top end portions 31*a* are in contact with the black stripes, which are a light absorbing layer of the screen 30, the widths of the black stripes are 0.07 mm. Since the number of support members is only 12, the manufacture thereof is simple and discharging occluded gas under a vacuum state can be ignored, and this does not cause deterioration of the life of the cathode-ray tube.

As a result of the simulation carried out by the inventors, in a case where a display device having a flat glass faceplate is formed, the thickness t of the faceplate is 2 mm or more, and the interval P between the adjacent support members is set to obtain ratio t/P of 0.050 or more. Thereby, the faceplate is deformed in the relatively large area by the above-mentioned atmospheric pressure, so that stress in compression is applied to the outer surface of the faceplate, and stress in tension is applied to the inner surface. Particularly, when stress in tension exceeds a critical value, sufficient strength can be given to the first destruction factor. Moreover, by use of the support members wherein the top end portions are wedge-shaped and the lengths of the top end portions in the longitudinal direction are 2 mm or more, sufficient strength can be given to the second destruction factor, which occurs by stress in tension concentratively generating in the glass in the vicinity of the top end portions of the support members when the faceplate glass is in contact with the support members. By combining the above structure, it is possible to reserve the flat vacuum envelop, which can withstand the first and second destruction factors and effectively support atmospheric pressure. Since the number of the support members is considerably small, large effect can be exerted in view of the manufacture of tubes and the life thereof. Moreover, since the weight of the cathode-ray tube can be reduced, the flat cathode-ray tube having high practical use can be easily manufactured.

The details of the simulation is the same as the first and the second embodiments.

The number of support members is preferably reduced in view of the operation of the tube. Since the peripheral edge of the faceplate is supported by the side wall of the vacuum envelope, resistance against atmospheric pressure at the peripheral edge is higher than that of the central portion of the faceplate. When a distance between the side wall and the support members adjacent to the side walls is shorter than the interval between the support members on the central portion of the faceplate, the number of support members can be reduced. The number of support members can be reduced if the thickness of the faceplate is made large. However, in consideration of the weight of the faceplate and that of the cathode-ray tube, the faceplate is preferably formed as thin as possible. Therefore, for example, the faceplate having a thickness of 15 mm or more is not favorable for practical use. Under this state, it is difficult to manufacture the glass plate in a float method, and productivity worsens. Moreover, the effect of the present invention can be considerably brought about in a case in which the thickness of the faceplate is thinner than that of the conventional cathode-ray tube having no support members. The thickness of the faceplate is preferably 10 mm or less, and the faceplate having a thickness of about 5 mm is light and favorable for practical use in view of the treatment.

Moreover, as shown in this embodiment, in the cathode-ray tube, which devisionally scans the screen by a plurality of electron guns, the adjacent electron guns must be positioned to be separated to a certain extent. The interval, that is, the distance between the center axes of the adjacent electron guns cannot be set to be 15 mm or less, depending on the structure of the electron guns In a case where the support members are arranged on the crossing points of the boundary lines of the divided regions of the screen, the interval of the arrangement must be at least 15 mm or more. Therefore, it is difficult to obtain the plate whose upper limit of the ratio t/P is over 1.0. The value of t/P by which the effect of this embodiment is considerably brought about is 0.67 or less, and 0.33 or less is preferably.

Also, the stress in which the length in the longitudinal direction is 2 mm or more becomes smooth in accordance with the length in the longitudinal direction as mentioned above. Further, the absolute value of the stress decreases as the contact area between the sheet glass and the support members increases. However, the process of the members and the assembly become difficult as the length L is increased in the longitudinal direction of the top end portions of the support members.

Regarding the processing the members, since it is necessary for the top end portions to contact the surface of the sheet glass in parallel, the degree of parallel of the top end portions are extremely important. Then, since it is difficult for the extremely long top end portions in the longitudinal direction to be processed, the limit of the length is 30 mm in view of practical use, that is, productivity. Moreover, in consideration of the forming accuracy of the sheet glass, a long members of the top end portions in the longitudinal direction are unfavorable. Regarding the assembly, since the top end portions must be arranged on the black stripes, the accuracy of position and the degree of parallel between the black stripes and the longitudinal direction of the top end portions are extremely important at the time of assembly. The accuracy limit at the time when the normal support members are assembled in parallel is 0.02° in view practical use. Moreover, if the length of the top end portions of the support members are about 30 mm or more, the assembly of the support members becomes considerably difficult. In this embodiment, in consideration of the area of the non-emitting portion and the simplicity of processing the members, the lengths of the top end portions in the longitudinal direction are set to 15 mm.

In this embodiment, the top end portion of each support members is wedge-shaped, and formed of a relatively thick metallic round rod. Therefore, the area contacting the rear panel is large, and these support members can be relatively easily assembled with high accuracy.

The above embodiment explained the structure in which the electron gun assemblies serving as electron sources are received in the necks formed in the second plate opposing to the small regions to devisionally scanned. However, the relationship between the interval between the support members and the thickness of the faceplate, and the shape of the top end portions of the support members are not limited to the above-mentioned structure. More specifically, the present invention is extremely useful to a display device wherein the supporting members are arranged between the faceplate to which the fluorescent screen is formed and the rear plate opposing to the faceplate, and supported at a predetermined interval, and the fluorescent screen is divided into a plurality of the small regions by a plurality of opposing electron sources, and scanned thereon. Therefore, in a case where the present invention is applied to the display device to which the linear cathode and the electrostatic deflection are combined, it is possible to further reduce the lower limit value of the interval between the adjacent support members in the structure of the electron guns shown in the above-mentioned embodiment. As a result, the range of the ratio t/P to be obtained is widened. In other words, the ratio t/P may be suitably set to adjust to the display device to which the present invention will be applied.

According to the present invention, the screen, which is divided into a plurality of regions and scanned thereon, is integrally structured, the flat sheet glass is used as a faceplate having the screen, and the flat sheet glass is also used as a rearplate to which the side walls, which are connected to the faceplate, and the funnels and the necks are connected to be parallel to the faceplate. Then, the support members are provided between these flat glasses according to a predetermined relationship, so that the vacuum envelop with a small number of support members and the flat faceplate can be formed. Moreover, since the faceplate and the rearplate are flat and the distance between each electron gun and the screen can be set to be minimum, magnification of the electron lens of the electron beam can be made small, and the spot on the screen is made small, thereby forming an image having high resolution. The depth of the device can be shortened, the weight thereof can be largely reduced as compared with the area of the screen, and the screen can provide clear images.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A display device comprising:

a vacuum envelope including a first flat plate which is substantially transparent and has an inner surface and a thickness t and a second flat plate faced to the inner surface of said first plate;

a fluorescent screen formed on the inner surface of said first flat plate;

means for generating first electron beams which dividedly scan said fluorescent screen, respectively; and a plurality of support members for supporting said first and second plates, which possess wedge-shaped top ends and are provided between said first and second plates and are arranged on said screen at a predetermined interval P, wherein a ratio t/P is 0.05 or more.

2. The display device according to claim 1, wherein said generating means further generates second beams which dividedly scan said screen, respectively and third electron beams which dividedly scan said screen, respectively.

3. The display device according to claim 1, wherein said generating means includes a plurality of electron gun assemblies, each generating the first electron beam.

4. The display device according to claim 1, wherein said fluorescent screen includes a continuous arrangement of segment screen regions, each screen segment region being scanned by the corresponding first electron beam.

5. The display device according to claim 4, wherein said fluorescent screen further includes boundaries, each boundary defining the adjacent screen segment regions.

6. The display device according to claim 5, wherein said support members have top end portions contacted to the boundaries on said screen, respectively.

7. The display device according to claim 6, wherein said screen segment regions are arranged in rows and columns and the top end portions of said support members are arranged on crossing points of the boundaries.

8. The display device according to claim 1, wherein said first plate has a thickness t of 2 mm or more.

9. The display device according to claim 1, wherein said generating means includes a plurality of electron gun assemblies, each emitting the first electron beam, and where each electron gun assembly is arranged at a distance of 15 mm or more from adjacent electron gun assemblies.

10. The display device according to claim 1, wherein said ratio t/P is set to 0.67 or less.

11. The display device according to claim 1, wherein the first plate has a peripheral section and a side wall extending from the peripheral section to the second plate.

12. A display device comprising:

a vacuum envelope including a first flat plate which is substantially transparent and has an inner surface and a thickness t and a second flat plate faced to the inner surface of said first flat plate;

a fluorescent screen formed on the inner surface of said first flat plate;

means for generating first electron beams which dividedly scan said fluorescent screen respectively; and a plurality of support members for supporting said first and second plates, which are provided between said first and second plates and are arranged on said screen at a predetermined interval, each of said support members having a top end portion contacting said screen, said top end portion being formed into a wedge-shape having a length L of 2 mm to 30 mm along a ridge of the wedge-shape.

13. The display device according to claim 12, wherein said generating means further generates second beams which dividedly scan said screen, respectively and third electron beams which dividedly scan said screen, respectively.

14. The display device according to claim 12, wherein said generating means includes a plurality of electron gun assemblies, each generating the first electron beam.

15. The display device according to claim 12, wherein said fluorescent screen includes a continuous arrangement of segment screen regions, each screen segment region being scanned by the corresponding first electron beam.

16. The display device according to claim 15, wherein said fluorescent screen further includes boundaries, each boundary defining the adjacent screen segment regions.

17. The display device according to claim 16, wherein the top end portions of said support members are contacted to the boundaries on said screen, respectively.

18. The display device according to claim 17, wherein said screen segment regions are arranged in rows and columns and the top end portions of said support members are arranged on crossing points of the boundaries.

19. The display device according to claim 12, wherein said generating means includes a plurality of electron gun assemblies, each emitting the first electron beam, and where each electron gun assembly is arranged at a distance of 15 mm or more from every other electron gun assembly.

20. The display device according to claim 12, wherein the first plate has a peripheral section and a side wall extending from the peripheral section to the second plate.

* * * * *